United States Patent [19]

Pichler et al.

[11] 4,004,381

[45] Jan. 25, 1977

[54] ARRANGEMENT FOR A PROTECTIVE COVER FOR THE EDGE OF SHEET METAL PANELS

[76] Inventors: Peter Pichler, Waldheim; Albert Jorg, Hergiswii, both of Switzerland

[22] Filed: Feb. 27, 1973

[21] Appl. No.: 336,321

[30] Foreign Application Priority Data

Feb. 29, 1972 Switzerland ..... 2918/72

[52] U.S. Cl. ..... 52/60; 52/288; 52/403

[51] Int. Cl. ..... E04d 1/36; E04d 13/15

[58] Field of Search ..... 52/60, 403, 58, 96, 52/288, 287, 95, 59

[56] References Cited

UNITED STATES PATENTS

| | | | |
|---|---|---|---|
| 2,776,460 | 1/1957 | Bottom | 52/403 X |
| 3,389,515 | 6/1968 | Hellebrand | 52/96 X |
| 3,449,873 | 6/1969 | Damato et al. | 52/288 X |
| 3,464,177 | 9/1969 | Amato | 52/287 |
| 3,691,708 | 9/1972 | Firkas | 52/403 X |

FOREIGN PATENTS OR APPLICATIONS

| | | | |
|---|---|---|---|
| 292,679 | 9/1966 | Australia | 52/60 |
| 267,154 | 3/1968 | Austria | 52/287 |
| 439,663 | 12/1967 | Switzerland | 52/60 |
| 1,144,551 | 3/1969 | United Kingdom | 52/287 |

OTHER PUBLICATIONS

Callaway Flashings, Sweets Catalog, 1962, 4 pages.

*Primary Examiner*—Ernest R. Purser
*Assistant Examiner*—Leslie A. Braun
*Attorney, Agent, or Firm*—Kenneth S. Goldfarb

[57] ABSTRACT

An arrangement for a protective cover for the edge of a sheet metal at roof-to-wall abutments, comprising a cover strip which is placed above the upper edge of the sheet metal edge panel. A clamping strap is employed which runs transversely with respect to the cover strip and thus with respect to the edge of the sheet metal panel and is attached to the wall by means of screws or nails. The clamping strap includes a flexible leg which stands off the wall and projects upwards. The upper edge portion of the cover strip is bent off twice against the wall, whereby the bent-off edge hooks behind the stand-off leg of clamping straps.

1 Claim, 1 Drawing Figure

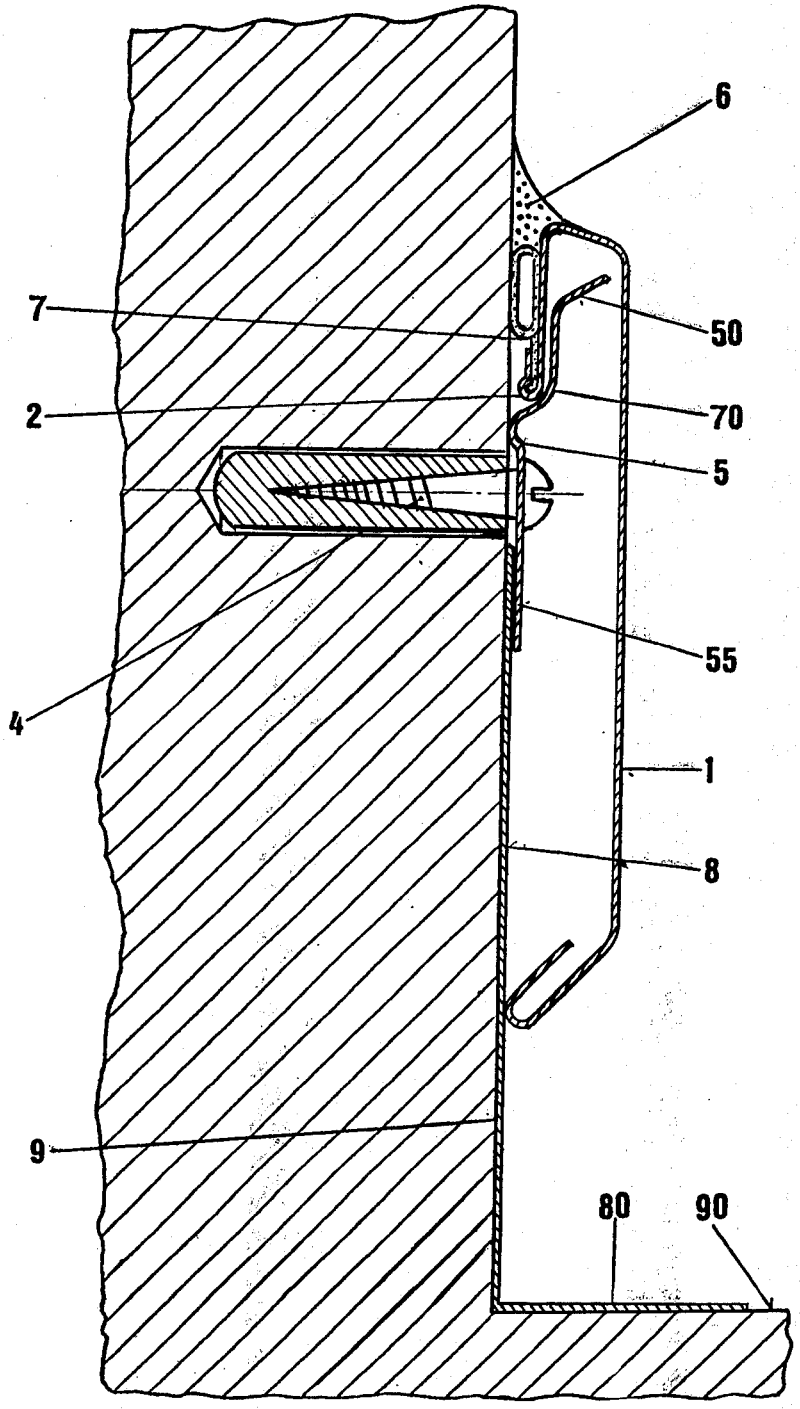
6
7
50
2
70
5
55
4
1
8
9
80
90

ARRANGEMENT FOR A PROTECTIVE COVER FOR THE EDGE OF SHEET METAL PANELS

BACKGROUND OF THE INVENTION

1. Field of the Invention

The invention concerns an arrangement for a protective cover for the edge of sheet metal panels at roof-to-wall abutments, consisting of a cover strip which is attached above the upper edge of the sheet metal edge panel, and its mode of attachment.

2. Description of the Prior Art

Superstructures projecting above the roof, for example chimneys, elevator motor enclosures, or the like, require a waterproof roof abutment. For this purpose, especially with flat roofs, a sheet metal panel is provided which is mounted at right angles with respect to the plane of the roof, and which is attached to the side wall of the superstructure. In order to offset the hazard of rain water entering behind the upper edge of sheet metal panel, the edge is sealed by means of a cover strip.

According to a familiar method, this cover strip is screwed to the wall which, however, has the disadvantage of water infiltrating along the screws and entering behind the sheet metal.

According to another proposal, cap screws whose caps are inserted in the T-slots of the tracks of the cover strips, are imbedded in the brickwork. This mode of attachment is impractical because the cover strips must be inserted lengthwise.

The familiar cover strips have another disadvantage: They are actually sealed by applying putty to the upper edge. Such puttied gaps, however, are known to become leaky with temperature fluctuations whose predominant effect is the formation of hairline cracks.

SUMMARY OF THE INVENTION

It is the object of the invention to eliminate these disadvantages.

The arrangement, according to the invention, includes individual clamping straps which are placed at a distance from one another and run transversely with respect to the cover strip and thus with respect to the edge of the sheet metal edge panel, too, and which are permanently attached to the wall, and by a flexible leg which projects upwards and stands off the wall, and furthermore by the upper edge portion of the cover strip being bent twice against the wall, whereby the bent-off edge hooks behind the stand-off leg of the clamping straps.

BRIEF DESCRIPTION OF THE DRAWING

The FIGURE shows a cross section through an example of execution of the invention.

DETAILED DESCRIPTION OF THE INVENTION

Cover strip 1, which extends in the form of connecting pieces over the whole length of the sheet metal panel, is attached to a wall or the like by means of clamping straps 5. The clamping strap consists of lower leg 55 which is adjacent to the center portion, and the upper leg 50. The latter is bent off several times so that it, among other things, forms a channel which accomodates the crimped-over edge 2 of cover strip 1. The end of upper leg 50 stands off wall 9 which facilitates inserting cover strip 1 from above. At the center portion, clamping strap 5 is attached to wall 9 by means of screw or a nail. The width of clamping strap 5 may be somewhat greater than the diameter of the cap of screw 4. However, it may also be of the same dimension as the longitudinal extension of the cover strip. In the former case, several clamping straps which are laterally spaced from one another, hold a clamping strip.

Seen in cross section, the two edge portions of cover strip 1 are bent off in U-shape or channel shape and thus form the T-slot of the cover strip, with its opening opposite wall 9. The upper edge is crimped over into a bead 2 which on the one hand is accomodated by the channel of leg 50 which secures the cover strip against unintentional lifting, and on the other hand bead 2 serves to hold hollow rubber cord 7 which is provided wite flap-band 70 and serves as a seal.

After positioning of sheet metal edge panel 8 which is pulled up on wall 9, clamping straps 5 are screwed to the wall by means of screws 4. The upper edge of cover strip 1 is clamped behind and above flexible upper leg 50 by means of its bead. In this manner, the spring tension of the upper leg 50 presses seal 7 flat against wall 9 which guarantees a secure seal against infiltration of water. The space between wall 9, seal 7, and the first bent-off portion of cover strip 1, which still remains above the cover strip, is closed with putty 6 which offers additional protection against the infiltration of water.

The section between the first and second bend of the upper edge portion is roof-shaped and pitched downwards, away from the wall, so that rain can run off.

The cover strip may be made of copper, chrome-steel, aluminum, galvanized sheet iron, copper-titanium-zinc sheeting, and the like.

The disclosed arrangement has several advantages. There are two safeguards against infiltration of water, whereby rubber seal 7 is absolutely tight. The sealing cord fastened to the bead is firmly bonded to the cover strip. It does not get lost, is always operating, and lends itself easily to the sealing process. Mis-manipulation is impossible. One workman simply attaches cover strips 1 by clamping them behind upper leg 50 of clamping strap 5. This strip may be removed and re-attached without damage. The clamping straps allow for expansion of the strip under the influence of heat variations. The butt-ends and corners may be protected by inserting cover strip sections of the same or of somewhat smaller cross section. The bent-off edge portions of the cover strip lend it rigidity.

A latitude of modification, substitution and change is intended in the foregoing disclosure, and in some instances some features of the invention will be employed without a corresponding use of other features.

We claim:

1. A protective cover arrangement for a sheet metal panel for protecting the edge thereof lying against a wall, comprising a clamping strap extending transversely of the edge of the sheet metal panel to be protected, means for securing said clamping strap to the wall, said clamping strap including a flexible upper leg spaced from the wall, and a cover strip having an upper edge provided with a U-shaped channel bent portion received between said upper leg and the wall, said bent portion of said cover strip being provided with an elastic seal partially received in said U-shaped channel bent portion, said seal being tubular in shape having a lateral flap with said flap being received in said U-shaped channel bent portion, the space between the wall and said cover strip above said seal being filled with sealing compound the lower edge portion of said cover strip being U-shaped and extending toward the wall, said clamping strap being secured to the wall above the edge of the sheet metal panel, said clamping strap overlying the edge of the sheet metal panel in order to press the sheet metal panel against the wall, said clamping strap having approximately the same length as said cover strip.

* * * * *